US005727408A

United States Patent [19]

Mizuno et al.

[11] Patent Number: 5,727,408

[45] Date of Patent: Mar. 17, 1998

[54] SIGNAL PROCESSING DEVICE WITH MAGNETISM ANTENNA AND KEY DEVICE WITH THE SIGNAL PROCESSING DEVICE

[75] Inventors: Takashi Mizuno; Sadao Kokubu; Hisashi Aoki; Shinichi Koga; Yoshiyuki Mizuno, all of Aichi, Japan

[73] Assignee: Kabushiki Kaisha Tokai Rika Denki Seisakusho, Aichi, Japan

[21] Appl. No.: 555,226

[22] Filed: Nov. 8, 1995

[30] Foreign Application Priority Data

| | | | |
|---|---|---|---|
| Nov. 14, 1994 | [JP] | Japan | 6-279045 |
| Nov. 14, 1994 | [JP] | Japan | 6-279046 |
| Nov. 18, 1994 | [JP] | Japan | 6-284741 |

[51] Int. Cl.[6] ..... E05B 19/26; H01Q 7/08

[52] U.S. Cl. ..... 70/413; 70/DIG. 46; 70/408; 343/788; 343/702

[58] Field of Search ..... 70/408, 413, 395, 70/DIG. 46; 343/788, 702

[56] References Cited

U.S. PATENT DOCUMENTS

| | | | |
|---|---|---|---|
| 3,780,373 | 12/1973 | Holst et al. | 343/788 |
| 4,562,712 | 1/1986 | Wolter | 70/456 R |
| 4,686,358 | 8/1987 | Seckinger et al. | 235/382 |
| 4,918,955 | 4/1990 | Kimura et al. | 70/277 |
| 4,922,736 | 5/1990 | Tanaka et al. | 70/277 |
| 4,939,792 | 7/1990 | Urbish et al. | 455/347 |
| 4,947,662 | 8/1990 | Imedio | 70/395 |
| 5,291,193 | 3/1994 | Isobe et al. | 340/825.69 |
| 5,311,757 | 5/1994 | Spahn | 70/408 |
| 5,337,588 | 8/1994 | Chhatwal | 70/278 |
| 5,433,096 | 7/1995 | Janssen et al. | 70/278 |
| 5,495,260 | 2/1996 | Couture | 343/795 |

FOREIGN PATENT DOCUMENTS

| | | | |
|---|---|---|---|
| 2 687 427 | 8/1993 | France . | |
| 4-11174 | 1/1992 | Japan | 70/DIG. 46 |
| 2 155 988 A | 10/1985 | United Kingdom . | |
| WO 92/07156 | 4/1992 | WIPO . | |

*Primary Examiner*—Steven N. Meyers
*Assistant Examiner*—Tuyet-Phuong Pham
*Attorney, Agent, or Firm*—Morgan, Lewis & Bockius LLP

[57] ABSTRACT

A key device includes a signal processing device for generating a signal containing specific information, a key plate having a stem and fitting device for fitting the signal processing device and the stem, the fitting device provided with the stem and the signal processing device, the fitting device of the signal processing device being formed while preliminarily resin-molding.

3 Claims, 5 Drawing Sheets

SIGNAL PROCESSING DEVICE WITH MAGNETISM ANTENNA AND KEY DEVICE WITH THE SIGNAL PROCESSING DEVICE

BACKGROUND OF THE INVENTION

1. Field of the Invention

The present invention relates to a signal processing device equipped with a magnetism antenna for receiving and transmitting magnetism and a key device equipped with the signal processing device.

2. Related Art

An example of an ignition switch for a motor vehicle has been proposed in which when a key plate is inserted into a key cylinder of the ignition switch, power is supplied from the key cylinder to the key device. As a result of the power supply, the signal generating device provided on the side of key device generates a signal containing specific information to be sent to the side of a vehicle (key cylinder) (The concrete structure is described in Japanese Patent Publn No. 4-15141). In such a configuration, on the vehicle side, on the basis of judgment of the information by detection of the above sent signal, whether or not key device is proper. This serves to prevent unauthorized unlocking.

The power supply and signal transmission/reception between the above key device and the key cylinder is performed by magnetic coupling. Specifically, the key device and the key cylinder are provided with magnetism antennas for making magnetic coupling, respectively. In this case, the magnetism antenna on the side of the key device is provided integrally to the signal generating device. The conventional configuration of such a signal generating device is shown in FIG. 6. The signal generating device 1, in which a magnetism antenna 3 and an IC 4 are mounted on a printed wiring board 2 as shown in FIG. 6, is fabricated through resin molding to provide a square-block-shaped mold body. The magnetism antenna 3 includes a round-rod-shaped ferrite core (magnetic core) 5 and a coil 6 wound around the ferrite core 5.

In the conventional configuration, the electromotive force generated in the coil 6 of the magnetism antenna 3 is proportional to the sectional area S of the ferrite core 5. The sensitivity of the magnetism antenna 3 can be improved as the sectional area S of the ferrite core 5 increases. On the other hand, the signal generating device 1 is embedded in the key grip of the key device. Specifically, the signal generating device 1 is attached at the stem of the key plate of the key device and secondarily resin-molded by to form the key grip.

In this case, the size of the key grip has an upper limit restricted to a ceratin degree in view of handling of the key, and is desired to be smaller. Therefore, it is required that the signal generating device 1 is preferably as small as possible, and the ferrite core 5 of the magnetism antenna 3 is as small as possible in its diameter. The conventional configuration provides a reduced sectional area S of the ferrite core 5. This leads to reduced sensitivity of the magnetism antenna. As a result, efficiency of power supply and signal communication between the signal generating device and the key cylinder is poor. This requires the distance between both to be shortened.

Further, the above conventional configuration requires, when a square-block-shaped mold body (signal generating device 4) is formed by molding the printed wiring board 6, requires a positioning pin for positioning the printed wiring board 6, thus making the structure of mold frames complicate and increasing the production cost.

SUMMARY OF THE INVENTION

An object of the present invention is to provide a signal processing device with a magnetism antenna with sufficiently high sensitivity while the signal processing device is held compact, and a key device having such a signal processing device.

Another object of the present invention is to provide a key device which can easily position a signal generating device to be preliminarily molded, thereby reducing the production cost. Another object of the present invention is to provide a key device which can make a holder for location unnecessary when a signal generating device preliminarily molded is secondarily molded to be positioned at the stem of a key plate, thereby reducing the number of components and man-hours of assembling.

The signal processing device equipped with a magnetism antenna according to the present invention, in a signal processing device in which on a printed wiring board are attached a magnetism antenna for receiving and transmitting magnetism and electric components constituting a signal processing circuit for processing the signal received by the magnetism antenna and a signal to be transmitted, is characterized in that said printed wiring board is made of a magnetism antenna; and said magnetism antenna is constituted by winding a coil around said printed wiring board.

In this configuration, it is preferable that when said printed wiring board is resin-molded to form a mold body, one end of said printed wiring is protruded from said mold body.

It is also more preferable that said signal generating device each of said configurations constitutes a signal generating device for generating a signal containing specific information, and said signal generating device is attached at the stem of a key plate, thereby providing a key device.

The key device according to the present invention, in a key device in which a signal generating device for generating a signal containing specific information preliminarily molded is secondarily resin-molded at a stem of a key plate, is characterized in that when said signal generating device is preliminarily molded, one end of a printed wiring board is protruded from a mold body.

In this configuration, it is preferable that at the stem of said key plate, a slit for receiving and sandwiching one end of said printed wiring board is provided. It is further preferable that at the one end of said printed wiring board, a protrusion is provided, and a groove into which said protrusion is fit is provided in the slit of said key plate.

The key device according to the present invention, in a key device in which a signal generating device for generating a signal containing specific information preliminarily resin-molded is secondarily resin-molded at a stem of a key plate, is characterized in that a mold body formed by molding said signal generating device is provided with a fitting portion for positioning; and at the stem of said key plate, a portion to be fit which is fit into the fitting portion of said mold body is provided to position said mold body.

In such a configuration, it is preferable that the fitting portion of said mold body is provided in the form of a groove, and the portion to be fit at the stem of said key plate is provided in the form of a protruding piece which is to be fit into said fitting groove. It is further preferable that when said signal generating device is preliminarily molded, one end of a printed wiring board is protruded from said mold body.

In accordance with the means, the printed wiring board of the signal generating device is made of a magnetic board and the coil is wound around the one end of the printed wiring board to constitute the magnetism antenna. Such a configuration, while holding the signal generating device compact, can make the sectional area of the ferrite core (ferrite board) of the magnetism antenna larger than that of the conventional configuration. This provides an excellent advantage of improving the sensitivity of the magnetism antenna in that degree. Further, since the printed wiring board is also used as a magnetic core, the number of components can be reduced and the signal processing device can be further miniaturized.

In the above configuration, when the printed wiring board is molded by resin to form a mold body, its one end is protruded from said mold body. With the protruded one end sandwiched between mold frames, therefore, the signal generating device can be located. This makes a location pin unnecessary so that the shape of the mold frames can be simplified, thus reducing the production cost.

The signal processing device having each of the above configurations constitutes a signal generating device for generating a signal containing specific information, and the signal generating device is attached at the stem of a key plate to constitute a key device. For this reason, the sensitivity of the magnetism antenna of the signal generating device can be enhanced, and hence the performance and quality of the key device can be improved. Particularly, in such an arrangement, the sensitivity of the magnetism antenna on the side of the key device is enhanced so that the communication distance between the magnetism antennas on the key device side and on the key cylinder can be increased. This improves freedom of design on the key device.

In accordance with the means described above, when said signal generating device is preliminarily molded, one end of a printed wiring board is protruded from said mold body. With the protruded one end picked up by a mold frame, therefore, the printed wiring board can be positioned. This makes a positioning pin unnecessary so that the shape of the mold frames can be simplified, thus reducing the production cost. Also when the signal generating device is preliminarily immersion-molded, with the protruded one end held, the printed wiring board can be immersion-molded, thus simplifying the molding working.

On the other hand, at the stem of said key plate, a slit for receiving and sandwiching one end of said printed wiring board is provided. Therefore, the one end of the printed wiring board has only to be inserted into the slit of the key plate in order to locate the signal generating device. As a result, in the secondary molding, the holder which was required conventionally can be made unnecessary. Further, at the one end of said printed wiring board, a protrusion is provided, and a groove into which said protrusion is fit is provided in the slit of said key plate. Thus, fitting the protrusion into the groove permits the signal generating device to be surely positioned.

In accordance with the means described above, the mold body formed by preliminarily molding the signal generating device is provided with the fitting portions for positioning, and at the stem of the key plate the portions to be fit are formed which are fit into the fitting portions to position the mold body. Thus, the portions to be fit of the key plate have only to be fit into the fitting portions of the mold body to position the signal generating device. As a result, in the secondary molding, the holder which was required conventionally can be made unnecessary, thereby permitting the number of components and man-hours of assembling to be reduced.

In this configuration described above, the fitting portions of the mold body are provided in the form of the fitting grooves, and the portions to be fit at the stem of the key plate are provided in the form of the protruding pieces which are to be fitted in the fitting grooves. Thus, the configuration for positioning can be concretely realized by a simple configuration. Further, when the signal generating device is preliminarily molded, one end of the printed wiring board is protruded from the mold body. Therefore, with the protruded one end sandwiched by mold frames, the signal generating device can be located. Thus, the pin for positioning can be made unnecessary so that the shape of the mold frames can simplified, thereby reducing the production cost.

DETAILED DESCRIPTION OF THE PREFERRED EMBODIMENTS

First embodiment

Figure 2:
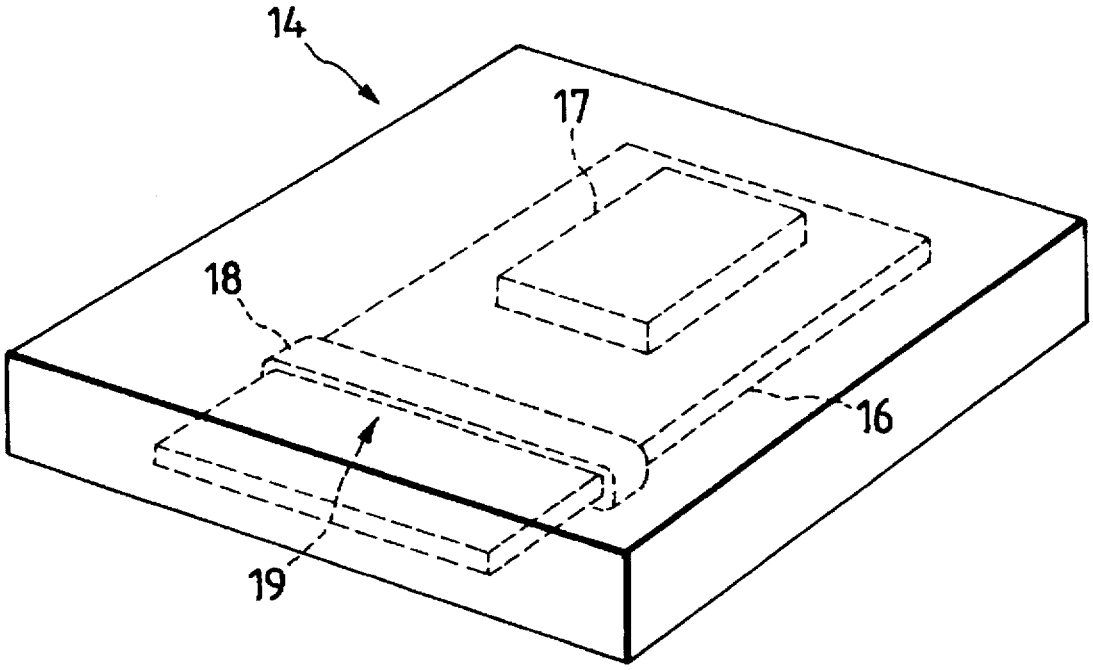
FIG. 2 is a perspective view of the signal generating device in a molded state.
Figure 3A:
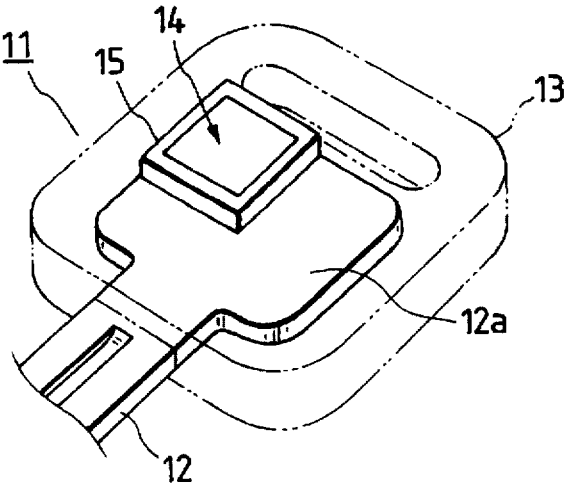
FIGS. 3 (*a*) and (*b*) are perspective view of a key device.
Figure 3B:
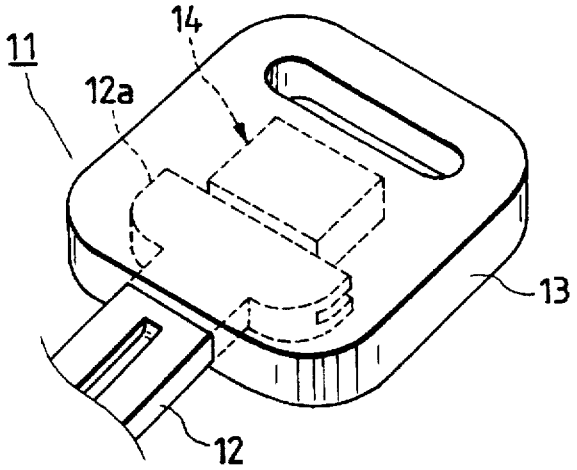

Now referring to FIGS. 1 to 3, an explanation will be given of the first embodiment in which the present invention is applied to a key device of e.g. a motorcar which is a vehicle. As seen from FIG. 3 (*a*) which shows a schematic entire configuration of the key device, a key device body 11 includes a key plate 12 and a key grip 13 made of resin formed at a stem 12*a* of the key plate 12. The key plate 12 serves to switch on an ignition switch (not shown) of a motor car when it is inserted into a key cylinder (not shown) of the ignition switch.

A signal generating device 14 which is square-blockshaped as a whole is embedded within the key grip 13. The signal generating device 14 constitutes a signal processing device according to the present invention. In this case, the signal generating device 14 is resin-molded at the stem 12*a* of the key plate 12 in a state positioned through a resin holder 15. By this resin molding, the key grip 13 (and hence the body 11) is formed.

Figure 1:
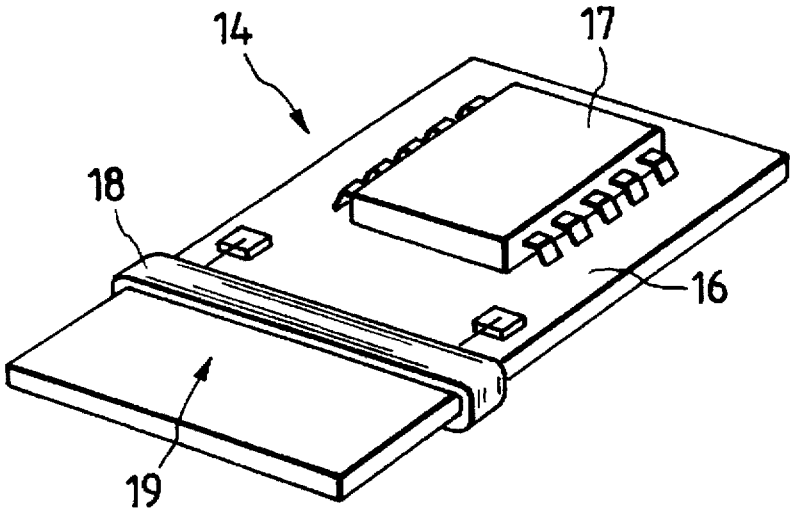
FIG. 1 is a perspective view of the signal generating device, illustrating the first embodiment of the present invention.

The signal generating device 14, as shown in FIG. 1, includes a printed wiring board 16 which is made of magnetic substance, e.g. a ferrite board, electric components such as an IC 17 or others mounted on the printed wiring board 16 and a coil 18 around the one end of the printed wiring board 16. In this case, the printed wiring board 16 and the coil 18 constitute a magnetism antenna 19. The printed wiring board 16 on which the IC and others are mounted and around which the coil 18 is wound is resin-molded to form a square- block-shaped mold body of the signal generating device as shown in FIG. 2.

In the above configuration, the coil 18 wound around the printed wiring board 16 is used both as a transmitting coil for transmitting a signal containing specific information, e.g., specific code signal and as a power-receiving coil magnetically coupled with a power supply coil (not shown) on the key cylinder side for power reception when the key plate 12 is inserted into the key cylinder. The electric components such as IC 17 constitute an electric circuit which operates by the electric power received through the above coil 18 to generate the specific code signal, and transmit this code signal through the coil 18.

On the other hand, the power supply coil on the key cylinder side of a motor vehicle is also used as a receiving coil for receiving the code signal transmitted from the coil 18 of the magnetism antenna. On the key cylinder side are provided a power supply circuit for supplying power to the power supply coil and a control circuit for controlling the power supply circuit, and also provided a detection circuit and a decision circuit for detecting the signal (code signal) received through the power supply coil and detecting whether the received signal is proper or not. When it is decided that the key plate 12 inserted into the key cylinder is not proper, an engine is not started. The concrete configuration of each of the electric circuits on the key cylinder side and key device side is well known from e.g., Japanese Patent Publn. 4-15141.

Figure 6:
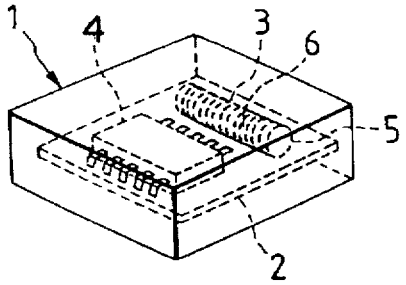
FIG. 6 PRIOR ART
FIG. 6 is a perspective view of the signal generating device having the conventional configuration.

In accordance With this embodiment having the above configuration, the printed wiring board 16 of the signal generating device 14 is made of the ferrite board and the coil 18 is wound around the one end of the printed wiring board 16 to constitute the magnetism antenna 19. Such a configuration, with the signal generating device held compact like the conventional configuration (FIG. 6), can make the sectional area of the ferrite core (ferrite board) larger than that of the conventional configuration (FIG. 6). This greatly improves the sensitivity of the magnetism antenna 19 as compared with that of the magnetism antenna 3 in the conventional shape. Since the printed wiring board 16 is also used as the ferrite core of the magnetism antenna 19, the number of components can be reduced and the signal generating device 14 can be further miniaturized.

Second embodiment

Figure 4:
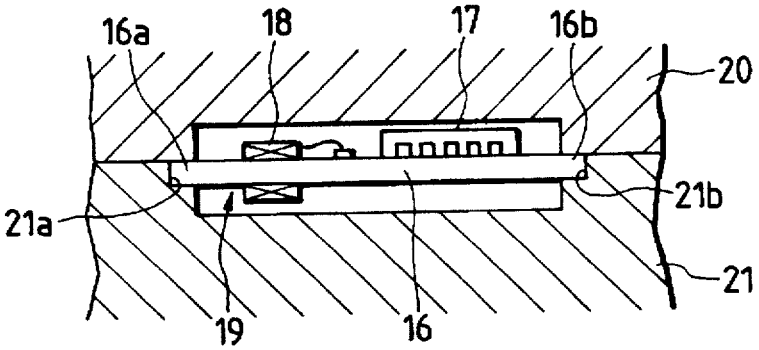
FIG. 4 is a longitudinal sectional side view a signal generating device and mold frames, illustrating the second embodiment.

FIG. 4 shows the second embodiment of the present invention. Only differences from the first embodiment will be explained. Like reference symbols in the second embodiment refer to like parts in the first embodiment. In the second embodiment, when the printed wiring board 16 is resin-molded to form a mold body, one end of the printed wiring board 16 is protruded from the mold body. Specifically, as shown in FIG. 4, with the left and right ends **16*a* and 16*b* of the printed wiring board 16 sandwiched between mold frames 20 and 21, the cavities of the mold frames 20 and 21 are filled with resin. Thus, the left and right ends 16*a* and 16*b*** are protruded from both left and right side ends of the mold body formed by molding.

In the above configuration, the left and right ends **16*a* and 16*b* of the printed wiring board 16 are fit into grooves 21*a* and 21*b* formed in the lower mold frame 21 so that they are sandwiched and fixed between the mold frames 20 and 21**. The remaining structure is the same as that in the first embodiment.

The second embodiment, therefore, can provide substantially the same operational advantages as the first embodiment. Particularly, in the second embodiment, in resin-molding the printed wiring board 16, the left and right ends **16*a* and 16*b* are sandwiched and fixed by the molding frames 20 and 21**. Thus, the pin for positioning can be made unnecessary so that the shape of the mold frames can simplified, thereby reducing the production cost.

In the second embodiment described above, although the left and right ends **16*a* and 16*b* of the printed wiring board 16 are protruded from both sides of the mold body, only either one end of the printed wiring board 16 may be protruded from the mold body. Further, in the second embodiment described above, although the signal generating device 14 is injection-molded using the mold frames 20 and 21, it may be also immersion-molded. In this case also, while the one and 16*a* or 16*b* of the printed wiring board 16 protruding from the mold body is held, the printed wiring board 16** can be immersion-molded, thereby simplifying mold working.

Third embodiment

Figure 5:
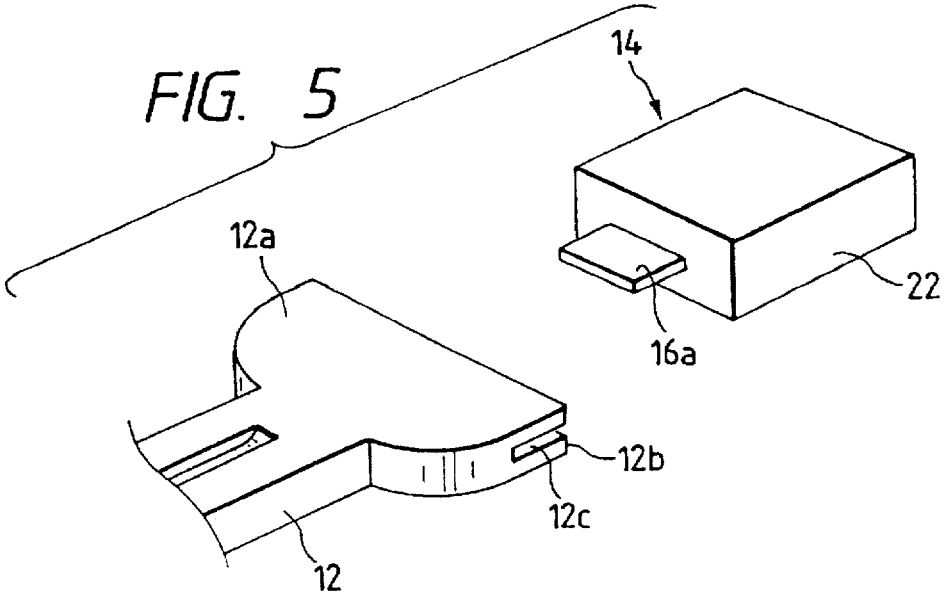
FIG. 5 is an exploded perspective view of a key plate and a signal generating device, illustrating the third embodiment.

FIG. 5 shows the third embodiment of the present invention. Only differences from the second embodiment will be explained. Like reference symbols in the second embodiment refer to like parts in the first embodiment. In the third embodiment, as shown in FIG. 5, the printed wiring board 16 is molded so that one end **16*a* of the printed wiring board 16 is protruded slightly long from one side of a mold body 22. The stem 12*a* of the key plate 12, as shown in FIG. 5, has a form whose width extends in a semi-circular shape. A slit 12*c* in which the one end 16*a* of the printed wiring board 16 of the signal generating device 14 is inserted and a fit is formed in its end surface 12*b* of the stem 12*a*. In this case, for example, by pressing the one end 16*a* of the printed wiring board 16 in to slit 12*c*, the signal generating device 14 can be positioned at the stem 12*a* of the key plate 12**.

In this positioning state, the stem **12*a* of the key plate 12 and the signal generating device 14 are secondarily resin-molded so that the key grip 13 (and hence body 11) can be formed. In this embodiment, although the one end 16*a* of the printed wiring board 16 is pressed into the slit 12*c***, the former may be only fit into the latter by insertion. In this fitting, both may be bonded to each other using an adhesive for example. The remaining structure is substantially the same as those of the first and second embodiments.

The third embodiment can provide substantially the same functional advantages as the first and second embodiments.

Particularly, in the third embodiment, when the signal generating device 14 is preliminarily molded, one end **16*a* of the printed wiring board 16*a* is protruded from the mold body 22. With the protruded one end 16 sandwiched by mold frames, therefore, the printed wiring board 16 can be located. In addition, the protruded one end 16*a* of the printed wiring board 16 is inserted and fit into the slit 12*c* of the key plate 12 in order to position the signal generating device 14 at the key plate 12. As a result, in the secondary molding of the stem 12*a* of the key plate 12, the holder 5 (FIG. 3** (*a*)) which was required conventionally can be made unnecessary, thus reducing the number of components and man-hours of assembling as shown in FIG. 3 (*b*).

Fourth embodiment

Figure 7:
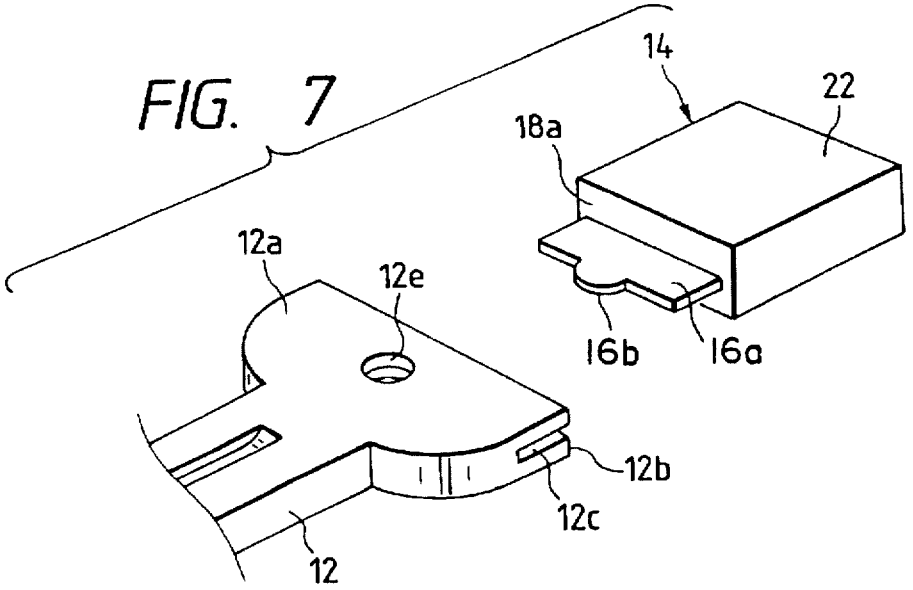
FIG. 7 is a view corresponding to FIG. 5 illustrating the fourth embodiment of the present invention.
Figure 8:
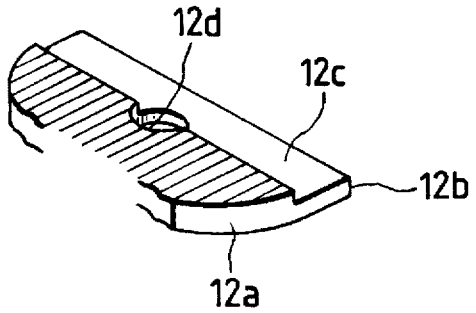
FIG. 8 is a partial exploded perspective view at the stem of the key plate.

FIGS. 7 and 8 show a fourth embodiment of the present invention. Only differences from the third embodiment will be explained. Like reference symbols in the fourth embodiment refer to like parts in the second embodiment. In the second embodiment, as shown in FIG. 7, a semi-circular protrusion **16*b*, for example, is provided at the center of the one end 16***a* of the printed wiring board 16. On the other hand, in the slit 12*c* of the key plate 12, as shown in FIG. 8, a groove 12*d* into which the protrusion 16*b* is to fit is provided. In this case, as shown in FIG. 7, at the stem 12*a* of the key plate 12*e*, a circular through-hole 12 is so formed that its semi-circular portion is superimposed on the slit 12*c*, thereby providing the above groove 12*d*.

In the fourth embodiment, the one end 17*a* of the printed wiring board 16 is inserted (pressed) into the slit 12*c* of the key plate 12, and in addition the protrusion 16*b* at the one end 16*a* of the printed wiring board 16 so that the signal generating device 14 can be positioned more surely. More specifically, insertion of the one end 16*a* of the printed wiring board 16 in the slit 12*c* suppresses the vertical movement in FIG. 7 of the printed wiring board 16. In addition, fitting of the protrusion 16*b* at the one end 16*a* of the printed wiring board 16 into the groove 12*d* suppresses the horizontal movement in FIG. 7 of the printed wiring board 16. The remaining structure is substantially the same as in the first embodiment. The fourth embodiment can provide substantially the same operational advantage as in the second embodiment.

Fifth embodiment

Figure 10:
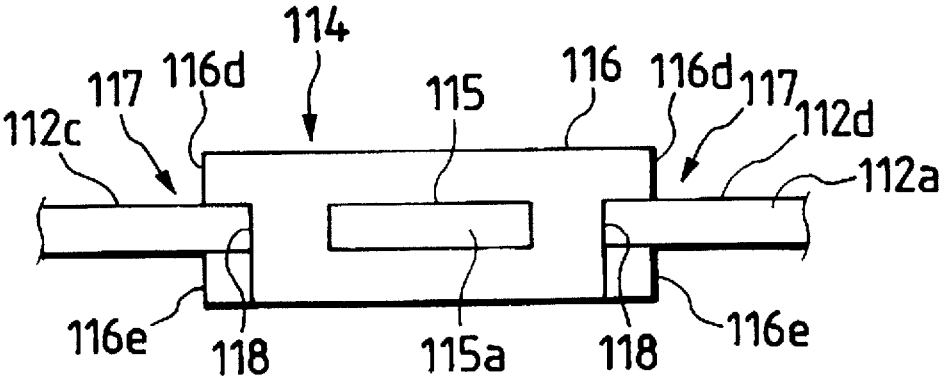
FIG. 10 is a side view of the key plate and signal generating device.
Figure 11:
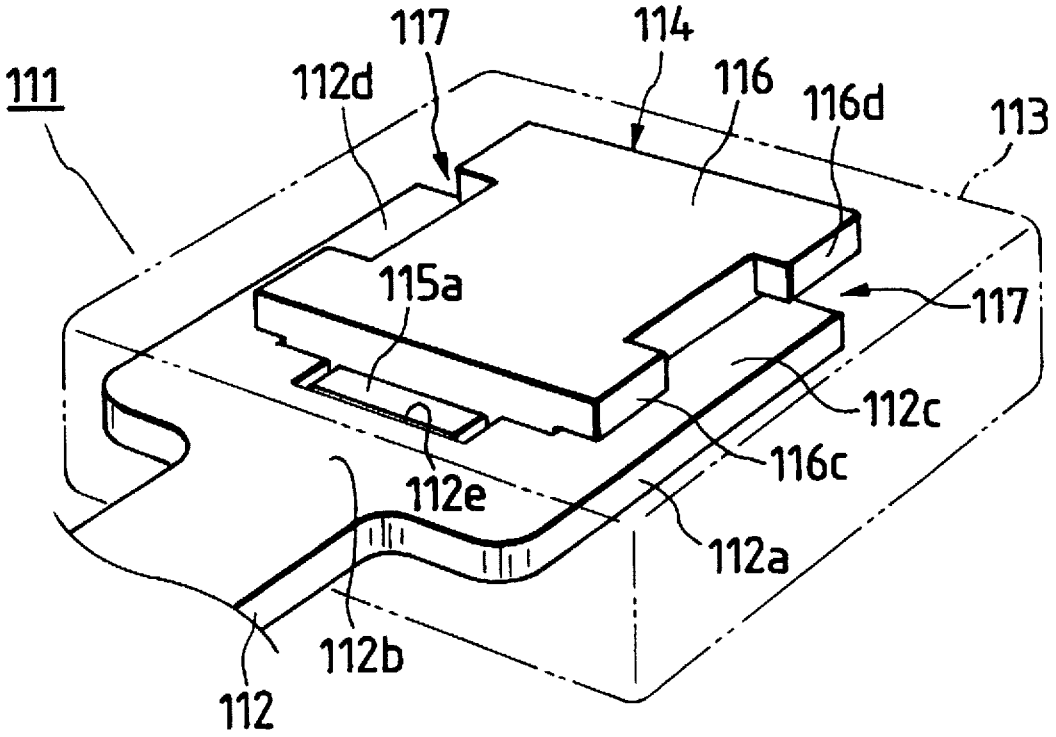
FIG. 11 is a perspective view of a key device production cost of the signal generating device.

Now referring to FIGS. 9 to 11, an explanation will be given of the first embodiment in which the present invention is applied to e.g., a key device of a motor vehicle. As seen from FIG. 11 which shows a schematic entire configuration of the key device, a key device body 111 includes a key plate 112 and a key grip 113 made of resin formed at a stem 112*a* of the key plate 112. The key plate 112 serves to switch on an ignition switch (not shown) of a motor vehicle when it is inserted into a key cylinder (not shown) of the ignition switch.

A signal generating device 114 which is square-block-shaped as a whole is embedded within the key grip 113. The signal generating device 114 is in the form of mold body 116 having a printed wiring board molded by resin molding. On the printed wiring board 115 are mounted electric components such as a magnetism antenna and IC (both not shown) for receiving and transmitting magnetism. Both ends 115*a* of the print wiring board 115 are protruded from both sides 116*a* of the mold body 116.

On both sides 16*b* which are different from both sides 116*a* of the mold body 116 are fitting portions 117, 117 for positioning. The fitting portion 117 has in the form of groove 118, for example. The fitting groove 118 is surrounded by two protrusions 116*c* and 116*d* formed at both upper ends of the side 116*b* of the mold body 116 and a single protrusion 116*e* formed at the lower center of the side 116*b* (FIGS. 9 and 10).

Figure 9:
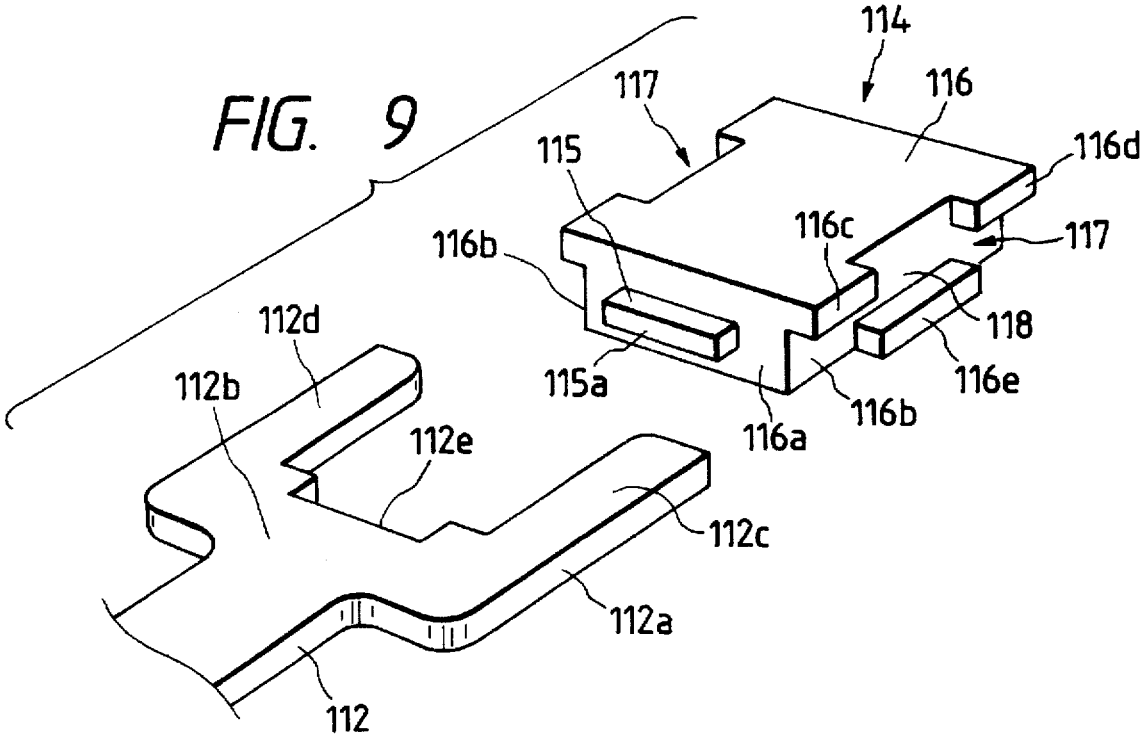
FIG. 9 is an exploded perspective view of a key plate and a signal generating device, illustrating the fifth embodiment of the present invention.

The stem 112*a* of the key plate 112 which is U-shaped as shown in FIG. 9 includes a stem base 112*b* and protruding pieces 112*c* and 112*d* which are opposite to each other. A groove 112*e* is formed at the end of the side of the protruding pieces 112*c*, 112*d* of the above stem 112*b*. The mold body of the signal generating device 114 is to be inserted and attached between the protruding pieces 112*b* and 112*c*. Specifically, the protruding pieces 112*c* and 112*d* are fit into the grooves 118 so that the mold body 116 is attached to be positioned on the stem 112*a* of the key plate 112.

In this case, the protruding pieces 112*c* and 112*d* constitute portions to be fit. The protruding pieces 112*c* and 112*d* may be fit into the grooves 118 by pressing. Otherwise, they may be only inserted into the grooves 118. In this case, both are preferably bonded to each other using an adhesive. Incidentally, when the mold body 116 is attached to the stem 112*a* of the key plate 112, the one end 115*a* of the printed wiring board 115 protruding from the side 116*a* of the mold body 116 is fit into the groove 112*e* of the stem base 112*b* of the stem 112*a* (FIG. 11). Under such an attaching state (or positioning), the stem 112*a* of the key plate 112 and the signal generating device 114 (mold body 116) is secondarily resin-molded to form the key grip 113 (and hence the body 111).

In accordance with this embodiment having such a configuration, when the signal generating device 114 is preliminarily molded, the fitting grooves 118 as the fitting portions for positioning are provided on both sides 116*b* of the mold body 116, and at the stem 112*a* of the key plate 112 the protruding pieces 112*a* and 112*d* are provided as the portions to be fit which are fit into the fitting grooves 118 to locate the mold body 116. Thus, the protruding pieces 112*c* and 112*d* at the stem 112*a* of the key plate 112 have only to be fit into the fitting grooves 118 of the mold body 116 to position the signal generating device 114 (i.e., mold body 116) at the stem 112*a* of the key plate 112. As a result, when the signal generating device 114 is positioned and secondarily molded at the stem 112*a* of the key plate 112, the holder 15 (FIG. 3 (*a*)) which was required conventionally can be made unnecessary, thereby permitting the number of components and man-hours of assembling to be reduced.

In this embodiment described above, when the signal generating device 114 is preliminarily molded, both ends 115*a* of the printed wiring board 115 are protruded from both sides 116*a* of the mold body 116. Therefore, with the protruded ends 115*a* sandwiched by mold frames (e.g. vertical mold frames), the signal generating device 114 can be positioned. Thus, the pin for positioning can be made unnecessary so that the shape of the mold frames can simplified, thereby reducing the production cost of the signal generating device 114.

In this embodiment, although both ends 115*a* of the printed wiring board 115 are protruded from both sides 116*a* of the mold body 116, only either one end of the printed wiring board 115 may be protruded from the one side 116*a* of the mold body 116. In this case also, substantially the same effect can be obtained. Further, in this embodiment, although the signal generating device 114 is molded by injection molding using mold frames, it may be also molded by immersion molding. In this case also, while the one end 115*a* of the printed wiring board 115 protruding from the mold body 116 is held, the printed wiring board 115 can be immersion-molded, thereby simplifying the molding working.

As apparent from the description hitherto made, the printed wiring board of the signal generating device is made of a magnetic board and the coil is wound around the one end of the printed wiring board to constitute the magnetism antenna. Such a configuration, while holding the signal generating device compact, can make the sectional area of the ferrite core (ferrite board) of the magnetism antenna larger than that of the conventional configuration. This provides an excellent advantage of improving the sensitivity of the magnetism antenna in that degree.

In the above configuration, when the printed wiring board is resin-molded to form a mold body, its one end is protruded from said mold body. With the protruded one end sandwiched by mold frames, therefore, the signal generating device can be positioned. This makes a positioning pin unnecessary so that the shape of the mold frames can be simplified, thus reducing the production cost.

The signal processing device having each of the above configurations constitutes a signal generating device for generating a signal containing specific information, and the signal generating device is attached at the stem of a key plate to constitute a key device. For this reason, the sensitivity of the magnetism antenna of the signal generating device can be enhanced, and hence the performance and quality of the key device can be improved. Particularly, in such an arrangement, the sensitivity of the magnetism antenna on the side of the key device is enhanced so that the communication distance between the magnetism antennas on the key device side and on the key cylinder can be increased. This improves freedom of design on the key device.

As understood from the description hitherto made, in accordance with the present invention, when said signal generating device is preliminarily molded, one end of a printed wiring board is protruded from said mold body. This makes a positioning pin unnecessary so that the shape of the mold frames can be simplified. Also when the signal generating device is preliminarily immersion-molded, the molding working can be simplified, thus reducing the production cost.

Further, in the above configuration, at the stem of said key plate, a slit for receiving one end of said printed wiring board is provided. Therefore, the one end of the printed wiring board has only to be inserted into the slit of the key plate in order to locate the signal generating device. As a result, in the secondary molding, the holder which was required conventionally can be made unnecessary. Further, at the one end of said printed wiring board, a protrusion is provided, and a groove into which said protrusion is fit is provided in the slit of said key plate. Thus, fitting the protrusion into the groove permits the signal generating device to be surely positioned.

As described above, in accordance with the present invention the mold body formed by preliminarily molding the signal generating device is provided with the fitting portions for positioning, and at the stem of the key plate the portions to be fit are formed which are fit into the fitting portions to position the mold body. Thus, the portions to be fit of the key plate have only to be fit into the fitting portions of the mold body to position the signal generating device. As a result, in the secondary molding, the holder 5 (FIG. 6) which was required conventionally can be made unnecessary, thereby permitting the number of components and man-hours of assembling to be reduced.

In this configuration described above, the fitting portions of the mold body are provided in the form of the fitting grooves, and the portions to be fit at the stem of the key plate are provided in the form of the protruding pieces which are to be fitted in the fitting grooves. Thus, the configuration for positioning can be concretely realized by a simple configuration. Further, when the signal generating device is preliminarily molded, one end of the printed wiring board is protruded from the mold body. Therefore, with the protruded one end sandwiched by mold frames, the signal generating device can be positioned. Thus, the pin for positioning can be made unnecessary so that the shape of the mold frames can simplified, thereby reducing the production cost of the signal generating device.

Each of the embodiments described above which is applied to the key device provided with the signal generating device 14 generating a magnetic signal may be applied to the key device provided with the signal generating device 14 generating an electric signal. It is applicable for employing the conventional key signal generating device when molding.

What is claimed is:

1. A signal processing device comprising:

a printed wiring board substantially completely formed of a magnetically active material;

a magnetism antenna for receiving and transmitting magnetism, wherein the magnetism antenna includes a coil wound around the printed wiring board; and a signal processing circuit disposed on the printed wiring board for processing a signal received by the magnetism antenna and a signal to be transmitted.

2. The signal processing device according to claim 1, wherein a resin-molded body is formed around the printed wiring board, one end of the printed wiring board protruded from the resin-molded body.

3. A key device, comprising:

a signal processing device including:

a printed wiring board substantially completely formed of a magnetically active material, a magnetism antenna for receiving and transmitting magnetism, wherein the antenna includes a coil wound around the printed wiring board, a signal processing circuit disposed on the printed wiring board for processing a signal received by the magnetism antenna and a signal to be transmitted, and a first molded body formed around the printed wiring board, the magnetism antenna, and the signal processing circuit, a portion of the printed wiring board protruding from the molded body; and a key plate having a stem, wherein the stem includes a slit for receiving and holding the protruded portion; and a second molded body enclosing the signal processing device and a portion of the key plate.

* * * * *